United States Patent [19]

Van Ormer

[11] 3,979,630

[45] Sept. 7, 1976

[54] SHADOW MASK COLOR PICTURE TUBE HAVING NON-REFLECTIVE MATERIAL BETWEEN ELONGATED PHOSPHOR AREAS AND POSITIVE TOLERANCE

[75] Inventor: David Dale Van Ormer, Lancaster, Pa.

[73] Assignee: RCA Corporation, New York, N.Y.

[22] Filed: Nov. 10, 1975

[21] Appl. No.: 630,596

Related U.S. Application Data

[63] Continuation of Ser. No. 168,484, Aug. 2, 1971, which is a continuation of Ser. No. 827,573, May 26, 1969, abandoned.

[52] U.S. Cl. ..... 313/408; 313/470; 313/478

[51] Int. Cl.[2] ..... H01J 29/32; H01J 31/20

[56] References Cited

UNITED STATES PATENTS

| | | | |
|---|---|---|---|
| 2,752,520 | 6/1956 | Morrell | 313/412 |
| 2,755,402 | 7/1956 | Morell | 313/408 |
| 2,842,697 | 7/1958 | Bingley | 313/472 |
| 2,947,899 | 8/1960 | Kaplan | 313/408 |
| 3,146,368 | 8/1964 | Fiore et al. | 313/408 |
| 3,223,872 | 12/1965 | Raibourn | 313/429 |
| 3,358,175 | 12/1967 | Morrell | 313/408 |
| R26,251 | 8/1964 | Kaplan | 313/408 |

*Primary Examiner*—Robert Segal
*Attorney, Agent, or Firm*—Glenn H. Bruestle; Dennis H. Irlbeck

[57] ABSTRACT

In one embodiment, a standard dot-type shadow mask color picture tube is modified by (1) increasing the glass transmission of the faceplate, and/or the mask aperture size, to increase the screen brightness; (2) making the color phosphor dots smaller and coating the space between the dots with an opaque and non-reflecting black matrix, to maintain acceptable contrast; and making the color phosphor dots sufficiently larger than the mask apertures that the beam spots on the screen are smaller than the dots (positive tolerance), to facilitate manufacture of the screen; while maintaining good purity tolerance and smaller but acceptable white uniformity tolerance. In another embodiment, a line screen-line grille shadow mask color picture tube is similarly modified.

4 Claims, 9 Drawing Figures

Fig. 1.
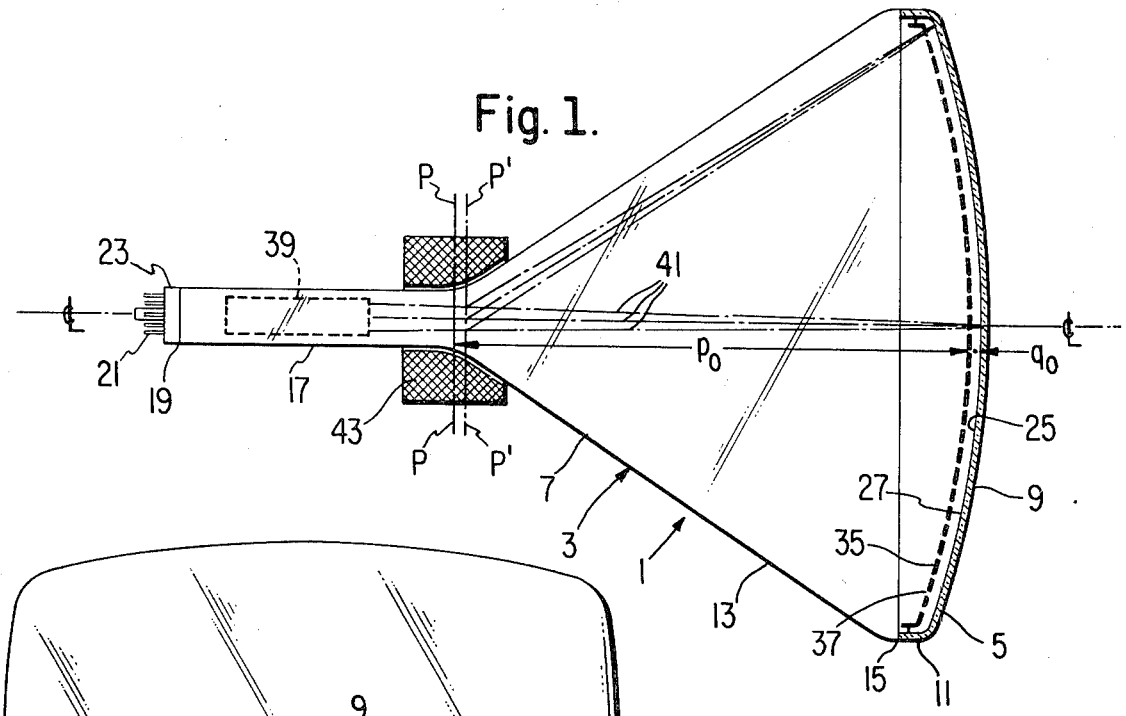
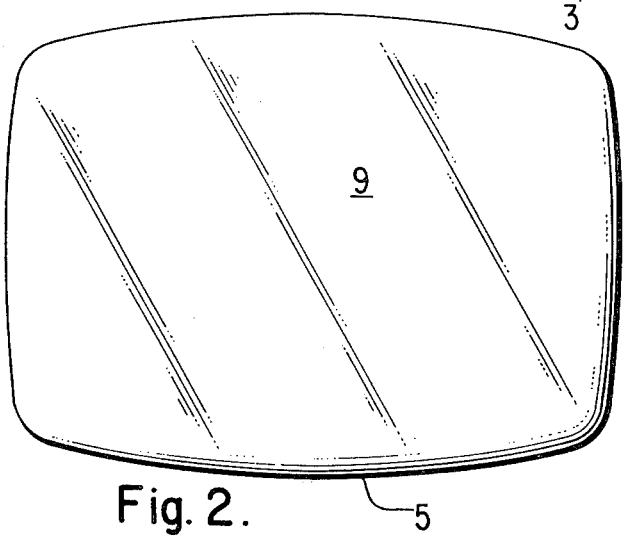
Fig. 2.
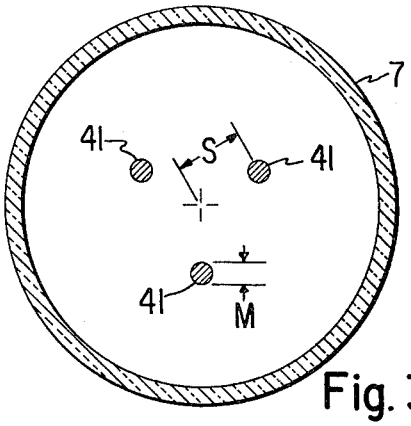
Fig. 3.
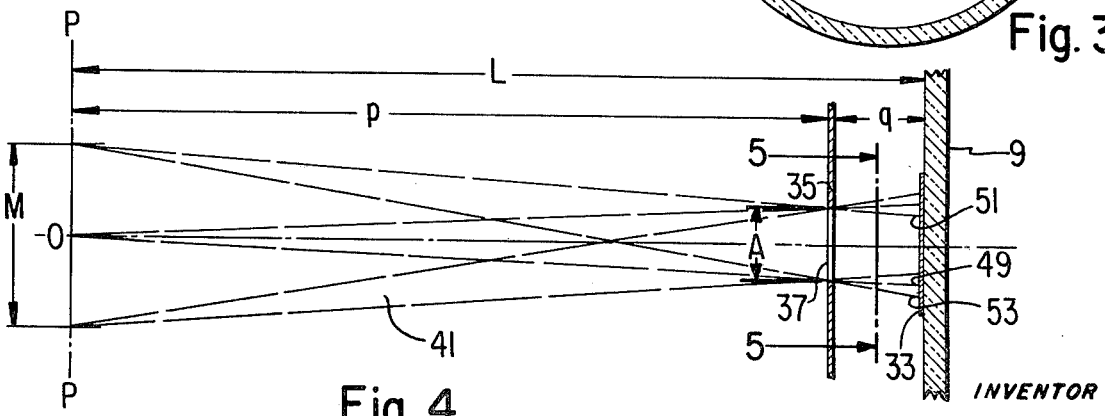
Fig. 4.
INVENTOR
David Dale Van Ormer
BY Thomas R. Webb
AGENT

INVENTOR

David Dale Van Ormer

BY Thomas R. Webb

AGENT

INVENTOR
David Dale Van Ormer
BY Thomas R. Webb
AGENT

SHADOW MASK COLOR PICTURE TUBE HAVING NON-REFLECTIVE MATERIAL BETWEEN ELONGATED PHOSPHOR AREAS AND POSITIVE TOLERANCE

This is a continuation of application Ser. No. 168,484, filed Aug. 2, 1971, which is a continuation of application Ser. No. 827,573, filed May 26, 1969, now abandoned.

BACKGROUND OF THE INVENTION

This invention relates to cathode ray tubes, and particularly to shadow mask type color picture tubes comprising a plurality of electron guns, a multi-apertured shadow mask, and a mosaic screen of systematically arranged color phosphor areas, such as dots or lines.

The standard shadow mask color picture tube, as presently manufactured and used in most color TV receivers, comprises a glass envelope including a large curved faceplate section or panel containing a curved mosaic phosphor screen and a curved shadow mask, and a funnel section including a small neck section containing three laterally spaced electron guns positioned at the three corners of an equilateral triangle. The tube is provided with internal and external means for converging the three beams from the three guns at or near the screen and external means for scanning the three beams in a rectangular raster over the mask and screen. The screen is made up of a multiplicity of small circular deposits or dots of red, blue and green emitting phosphor material arranged in a hexagonal pattern in triangular groups or triads of red, blue and green dots in each triad. The shadow mask is a thin metal member having a multiplicity of circular apertures, one for each dot triad, also arranged in a hexagonal pattern. The mask is removably mounted, as by means of studs and leaf springs, on the panel next to the screen. The spacing between the mask and screen, which averages about one-half inch, is chosen at each radial distance to provide desirable grouping of the electron beam spots on the screen at each radial distance from the center during operation of the tube.

Each color pattern of the mosaic screen is deposited on the glass faceplate by a direct photographic process wherein a photosensitive coating is exposed through the mask apertures by actinic rays from a light source located at, or related to, the source of one of the electron beams, and the coating is then developed, by washing off the unhardened unexposed portions, leaving the desired pattern of exposed hardened dots. This process is repeated for each color pattern. The color phosphor powder may be mixed directly with each photosensitive coating before application to the faceplate, or applied to the pattern after exposure.

During the exposure of the coating, the exposed dot portions are caused to grow so that the final dots are several mils larger than the mask apertures. In tube operation, the electron beam portions which pass through the apertures are also caused to grow but to a lesser extent, so that the penumbra of each beam spot on the screen is also larger than the mask aperture but smaller than the phosphor dot that it impinges. The difference in diameter between the beam spot and its dot, minus the total overlap (if any) of the dot with the adjacent dots on opposite sides thereof, is known as the "white uniformity tolerance", or "leaving tolerance". It is the total range of movement of a particular beam spot relative to its color dot without reducing the amount of light of that color emitted. In a standard shadow mask tube, where the spot is smaller than the dot, this tolerance is called a "positive" tolerance. Another tolerance to be considered is the "purity tolerance" or "clipping tolerance". This is the total range of movement of a particular spot relative to its own color dot without impinging on (clipping) an adjacent dot of a different color, and is equal to twice the distance between the centers of two adjacent dots minus the diameter of the dot minus the diameter of the beam spot (penumbra), for dots having equal size and spacing. As an example, in the central region of a 25 inch 90° rectangular shadow mask color tube, RCA-25AJP22, manufactured by applicant's assignee, the mask apertures have a diameter of 12 mils and a spacing of 28.1 mils; the phoshor dots have a maximum diameter of 17.8 mils and an average center-to-center spacing of 16.95 mils (overlapping dots); in which case the beam spot diameter is about 13.7 mils; the minimum leaving tolerance is about 2.4 mils, and the clipping tolerance is about 2.4 mils. Since the mask apertures are only 12 mils, the beam transmission at the center of the standard mask is only about 16.5%, which limits the available light output or brightness of the screen. Moreover, the light output of the tube is further reduced by the necessity for using a gray glass faceplate having a light transmission of only 41% in order to maintain acceptable contrast by minimizing internal halation effects and reflections of ambient light from the screen. The contrast is the ratio of the highlight (brightest portion) of the screen to the lowlight (unexcited portion).

As the beams are deflected (scanned) toward the edge of the screen they are subjected to electrical and magnetic effects, such as axial shift of the centers of deflection with increasing deflection angle, outward shift of the deflection centers with dynamic convergence, astigmatic effects in the deflection yoke, and the earth's magnetic field, which do not affect the light rays during screen printing, and hence, which tend to cause misregister of the beam spots with their corresponding dots during tube operation. Although most of these effects are compensated for by using a special light refracting member or lens, e.g., as disclosed in Epstein et al. U.S. Pat. No. 2,885,935, dated May 13, 1959, or Morrell et al. 3,282,691, dated Nov. 1, 1966, in the screen printing operations, some misregister errors remain. Therefore, greater tolerances are required at the edges and corners than at the center of the screen. For this reason, the mask apertures are graded in size from a maximum at the center to a minimum at the corners, and substantially more growth of the dots is produced at the edge than at the center during screen printing. In the standard 25 inch tube referred to above, the apertures in the corners of the rectangular mask at a distance of 11.25 (inches) from the center have a diameter of 10 mils and a spacing of 27.7 mils, the phosphor dots have a diameter of 16 mils and an average center-to-center spacing of 16 mils, and the beam spot diameter is about 11.6 mils; and hence, the leaving and clipping tolerances are both about 4.4 mils. The beam transmission of the mask at the corners is only about 12%, so that the light output is about 30% less than at the center of the screen.

If a more transparent faceplate is used, to increase the light output or brightness, the result is an undesirable net decrease in contrast, because the reflectivity of the screen varies as the square of the glass transmission. On the other hand, if the mask apertures are made larger, to increase the light output and the contrast, the leaving and clipping tolerances are both decreased, which has heretofore been considered intolerable.

U.S. Pat. No. 2,842,697 to F. J. Bingley describes a color picture tube of the line screen type, e.g., a sensing tube with indexing strips, in which the different color emitting phosphor strips are spaced from each other to increase the color purity tolerance, and also permit the use of a larger beam spot without having the spot overlap more than one (desired) color strip at a time, to increase the brightness of the reproduced image. Moreover, the spaces between the color strips are filled with opaque and non-reflecting material to reduce halations and the reflectivity of the screen to ambient light, and thereby increase the contrast of the image. Since the beam spot is wider than each color phosphor strip, Bingley's line screen tube is a negative tolerance tube. In columns 8 to 10, Bingley described (without illustration) his invention as applied to "the conventional so-called 'aperture mask' type of color television display tube". He suggested depositing opaque and non-reflective material on the faceplate in a pattern (matrix) corresponding to the interstices between the phosphor dots of the completed screen, and depositing the respective sets of phosphor dots in the spaces in the deposited pattern of opaque material. He stated that the phosphor dots may be slightly larger than the holes in the opaque pattern provided that they do not encroach on the adjacent holes of different color dots. Thus, the holes must be spaced apart. The patent is silent as to whether the mask apertures are larger or smaller than the holes in the opaque pattern. However, it may be assumed that Bingley's shadow mask embodiment is a negative tolerance tube like the line screen embodiment, and hence, that the mask apertures must be large enough to produce beam spots larger than the holes in the opaque pattern. Bingley's shadow mask embodiment is described more in detail in U.S. Pat. No. 3,146,368 to J. P. Fiore and S. H. Kaplan. In this patent, the mask apertures as well as the beam spots are described as being larger than the color phosphor dots as shown in FIGS. 2 and 4. Because of this negative tolerance relationship, it is difficult to deposit the dots and surrounding non-reflective matrix material on the faceplate by direct photographic methods without temporarily changing the effective size of the mask apertures during the screen printing operation, because of the normal tendency of the dots to grow in size during light exposure.

SUMMARY OF THE INVENTION

An object of the present invention is to provide a shadow mask type color picture having substantially improved brightness and acceptable contrast and acceptable positive tolerances.

Another object is to provide a shadow mask color tube having a matrix type screen that is relatively easy to manufacture by direct photograhic printing methods.

These and other objects are accomplished, in one embodiment of the invention, by modifying the standard dot-type shadow mask tube as follows:

1. The glass transmission of the faceplate, including any safety window laminated thereto, is increased substantially to increase the light output;

2. The effective diameter of the color phosphor dots is decreased somewhat below tangency with adjacent dots, within the limits of acceptable positive tolerance, and the interstitial space between the spaced dots is coated with a matrix of opaque and non-reflective material, to compensate for the effect of the increase in glass transmission and thereby maintain acceptable contrast; and
3. Preferably also, the diameter of the mask apertures is increased, sacrificing a large part of the white uniformity tolerance heretofore considered essential, to further increase the light output of the tube.

The clipping (purity) tolerance is increased by the decreased dot size and is decreased by the increased mask aperture size. Therefore, these effects tend to cancel to produce a tube having a clipping tolerance about the same as the standard tube. However, the decrease in dot size and increase in aperture size are cumulative in reducing the white uniformity tolerance. In the early stages of color television, most of the television broadcasts were still in black-and-white, and hence, white uniformity, or color-balance, was necessary to avoid showing blotches of color on black-and-white images caused by misregister of the beam spots and color dots. However, there are now two reasons why white uniformity tolerance can be substantially reduced. First, now that most programs are broadcast in color, there are comparatively few black-and-white images seen on color receivers to be affected by poor white uniformity, and poor white uniformity due to slight misregister is not very noticeable on color images. Second, due to improvements in screen printing, smaller tolerances can now be tolerated. Therefore, the present invention is producated on the realization that smaller white uniformity tolerance can be accepted particularly in the center of the screen, and involves the trade-off of white uniformity tolerance for substantially greater light output, with acceptable contrast and purity tolerance.

The invention is also applicable to other shadow mask type color tubes, such as one having a line or strip screen and a grille or elongated aperture mask.

BRIEF DESCRIPTION OF THE DRAWING

FIG. 1 is a top plan view, partly in axial section, of a three-beam shadow mask color picture tube embodying the present invention;

FIG. 2 is a front end view of the tube of FIG. 1;

FIG. 3 is a transverse section, taken on line P—P of FIG. 1, showing a delta beam arrangement.

FIG. 4 is a sketch showing the defining electron paths of one of the three beams of FIG. 1 as it is scanned across an aperture;

DESCRIPTION OF THE PREFERRED EMBODIMENTS

Figure 5:
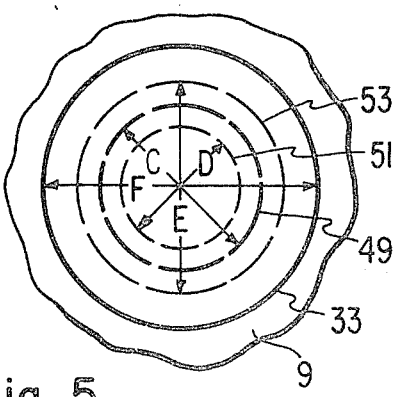
FIG. 5 is a view taken in the direction of the arrows 5—5 of FIG. 4.

Referring to FIG. 1, the color picture tube 1 comprises a glass envelope 3 made up of a faceplate section or panel 5 sealed to a funnel section 7. The panel 5 comprises a relatively large faceplate 9 having a substantially spherical contour and, preferably, a generally rectangular shape, and a peripheral axial flange 11. The funnel 7 comprises a frusto-conical portion 13 having its larger end frit-sealed at 15 to the panel flange 11 and its smaller end joined to one end of a small diameter neck portion 17. The other end of the neck portion 17 is closed by a stem 19 having stiff leads 21 and a base 23.

Figure 6:
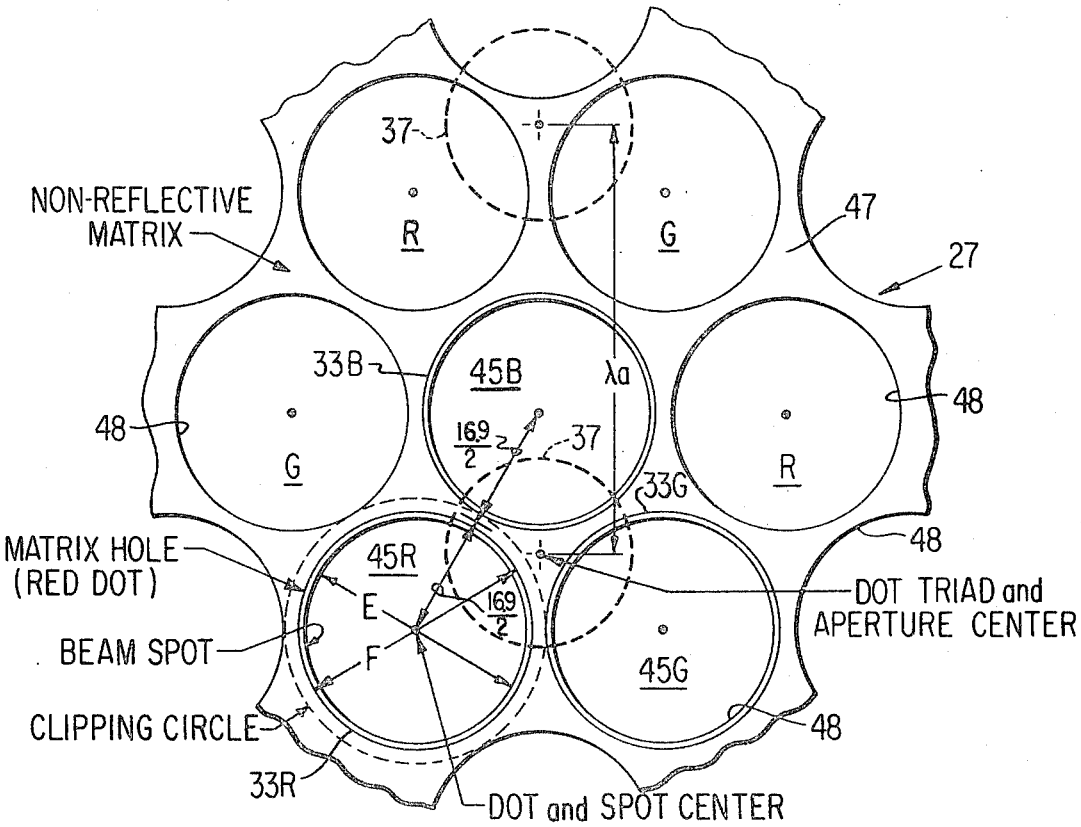
FIG. 6 is a view, similar to FIG. 5, showing a seven-hole fragment of the matrix of the screen of FIG. 1.

The inner surface 25 of the faceplate 9 is provided with a mosaic screen 27, shown in detail in FIG. 6, comprising a multiplicity of circular deposits of red, green and blue light emitting phosphor materials systematically arranged in a hexagonal pattern to form triangular groups or triads of spaced red, green and blue phosphor dots 33, e.g., 33R, 33G and 33B in FIG. 6. A curved multi-apertured shadow mask 35 of substantially spherical contour is removable mounted within the panel 5 in spaced relation to the screen 27, as by conventional studs and leaf springs (not shown). The mask 35 is preferably a thin (e.g., 6 mils) sheet of cold-rolled steel. The mask 35 is formed with a hexagonal pattern of circular apertures 37, one for each triad of phosphor dots 33. The magnified projections of two of the mask apertures 37 are shown as dotted circles in FIG. 6.

Mounted within the neck portion 17 is a conventional delta type electron gun structure 39 for generating and projecting three converging electron beams 41 from the corners of an equilateral triangle toward the screen 27. In operation of the tube, the convergent beams 41 are deflected or scanned over the surface of the screen 27 by means of a magnetic yoke 43 surrounding the tube. The plane P—P in FIG. 1 is the plane of deflection (or apparent origin) of the beams at zero deflection, with the three beams converged at the center of the screen 27. FIG. 3 shows the delta or triangular arrangement of the three beams 41, wherein each beam is radially spaced, in the plane P—P, a distance S from the central axis at zero deflection. As the angle of deflection increases, the plane of deflection moves toward the screen, to a plane P′—P′ for maximum deflection. The distance along the central axis between the plane of deflection P—P and the mask 35 is indicated as $p_o$, and the spacing between the mask 35 and screen 27 is $q_o$. The total distance $p_o + q_o$ from plane P—P to the screen is $L_o$. In general, $p$, $q$ and L are measured along the beam path. The ratio $\lambda = L/P$ is called the magnification of the tube. Since $p$ increases with the angle of deflection, the three beams would converge undesirably before reaching the screen if the convergence angle were kept constant. To avoid this, and maintain convergence at the screen, the beams are subjected to dynamic convergence during scanning, by conventional means (not shown), which produces an outward shift or offset of the three centers of deflection in the plane of deflection P′—P′ at maximum deflection. The portions of the three beams that pass through a particular mask aperture 37 diverge between the mask and the screen, and impinge on the screen 27 as a trio of spaced beam spots 45, e.g., 45R, 45G and 45B in FIG. 6, each preferably exactly centered or registered with the corresponding phosphor dot 33.

FIGS. 4 and 5 show the paths of the electrons of a beam 41 passing through an aperture 37 and impinging on a phosphor dot 33 on the faceplate 9, e.g., near the center of the screen, as the beam is scanned across the aperture. A is the aperture diameter, and M is the diameter of the beam 41 in the plane of deflection P—P. The conical projection on dot 33 of the point O in the plane P—P through the aperture 37 produces the circle 49, of diameter $C = A\lambda$. As the beam is scanned over the aperture 37, the beam produces umbra and penumbra circles 51 and 53, having diameters D and E, respectively. $E-C = C-D = M\times P/q$, therefore $E = C+Mp/q$ and $D = C-MP/q$.

The tube structure described thus far may be identical with the structure of the standard 25 inch −90° rectangular shadow mask color tube, type 25AJP22, for example, which has a glass faceplate with a light transmission of about 41%.

In accordance with one embodiment of the present invention, (1) a glass is chosen for the faceplate 9 which alone, or in combination with any safety window which is to be laminated thereto, has a net light transmission substantially greater than the 41% transmission of the standard tube faceplate, in order to increase the light output substantially; and (2) the color phosphor dots 33 are spaced from each other by a matrix 47 of sufficient opaque and non-reflective material having holes 48 containing the dots 33, to maintain about the same contrast as the standard tube, while maintaining acceptable spot-dot misregister tolerances, the size of the mask apertures being sufficiently smaller than the size of the matrix holes to maintain positive white uniformity tolerance.

In a preferred example, the pertinent design data for a tube with about 69% glass transmission embodying the invention is shown in the last two columns of the following Table I, as compared with the corresponding data in the first two columns for the standard 25AJP22 tube having 41% glass transmission, the same aperture spacing $a = 28.1$ mils at the center and 27.7 mils at the corners, $M = 54$ mils, $S = 0.219$ inch, $p = 13.113$ inches at the center and 15.699 inches at the corners, $q = 0.584$ inch at the center and 0.578 inch at the corners, $L = 13.697$ inches at the center and 16.277 inches at the corners, and $\lambda = 1.0445$ at the center and 1.0368 at the corners:

TABLE I

| | Standard Tube | | Matrix-Dot Tube Example I | |
|---|---|---|---|---|
| | Center | Corners | Center | Corners |
| Glass transmission $t_u$ (%) | 41 | 41 | 69 | 69 |
| Mask aperture diam. A (mils) | 12.0 | 10.0 | 13.1 | 10.0 |
| Mask transmission $T_m$ | .1654 | .1182 | .1971 | .1182 |
| Beam spot - effective C (mils) | 12.5 | 10.4 | 13.7 | 10.4 |
| Beam spot - Penumbra E (mils) | 13.7 | 11.6 | 14.9 | 11.6 |
| Dot or matrix hole F (mils) | 17.8 | 16.0 | 16.0 | 15.0 |
| Matrix transmission $T_M$ | — | — | .808 | .742 |

TABLE I-continued

| | Standard Tube | | Matrix-Dot Tube Example I | |
|---|---|---|---|---|
| | Center | Corners | Center | Corners |
| Ratio $T_M/T_m$ | — | — | 4.1 | 6.3 |
| Relative light output RLO | 1.0 | .715 | 2.0 | 1.2 |
| Screen reflectivity $r_s$ | .1562 | .1562 | .306 | .284 |
| Stray light SL (ft. lamberts) | 1.0 | .715 | 2.0 | 1.2 |
| Contrast ratio CR | 38.34 | 35.1 | 38.5 | 34.3 |
| Relative contrast RC | 1.0 | 1.0 | 1.0 | .98 |
| Leaving tolerance LT (mils) | 2.4 | 4.4 | 1.1 | 3.4 |
| Clipping tolerance CT (mils) | 2.4 | 4.4 | 3.0 | 5.4 |

In Table I, the mask transmission $T_m$ is $$.9069\left(\frac{A}{a}\right)^2,$$

the matrix transmission $T_M$ is $$.9069\left(\frac{F}{\lambda a}\right)^2 \times 3,$$

and the tube reflectivity $r_s$ is $0.04 + (0.96)^2 \times 0.75 \times (t_g)^2 \times T_M$, where 0.04 is the reflectivity of the faceplate surface, 0.96 is the fraction of the ambient light not reflected by the faceplate, and 0.75 is the reflectivity of the phosphor screen. The relative light output RLO is $$\frac{t_{g\text{-}MD}}{t_{g\text{-}std}} \times \frac{T_{m\text{-}MD}}{T_{m\text{-}std}}.$$

The contrast ratio =

$$\frac{\text{highlight brightness} + \text{ambient light} \times \text{tube reflectivity}}{\text{ambient light} \times \text{tube reflectivity} + \text{light due to strays}},$$

and the relative contrast $$\frac{\text{contrast ratio of the new tube}}{\text{contrast ratio of the standard tube}},$$

at the same anode power, and under the same ambient light. The data given are for 2 foot lamberts of ambient light. The light due to stray electrons has been measured as 1 foot lambert at the center of the standard tube and 2 foot lamberts at the center of the M.D. tube in Table I. The stray light is proportional to the glass transmission and to the area of the mask apertures. In calculating contrast ratio the brightness at the center of the standard tube is taken as 50 foot lamberts. Thus, the center CR for the standard tube is $$\frac{50 + 2 \times .1562}{2 \times .1562 + 1} = 38.34.$$

The leaving tolerance LT is F—E (minus the total dot overlap, in the standard tube), and the clipping tolerance CT is $$\frac{2a\lambda}{\sqrt{3}} - F - E.$$

The term $$\frac{2a\lambda}{\sqrt{3}},$$

in the clipping tolerance, is twice the diameter of tangent dots. At the corners of the screen, this term is reduced 1.9 mils, from the calculated value of 33.9 mils, to 32 mils, for the example given, to correct for triad distortion.

As shown in Table I, increasing the faceplate transmission $t_g$ from 41 to 69%, increasing the mask aperture diameter A from 12 to 13.1 mils, reducing the effective diameter of the phosphor dots 33 from 17.8 to 16.0 mils (matrix hole diameter F), and adding the opaque and non-reflecting matrix 47 produces a positive tolerance, matrix-dot, shadow mask tube having twice the light output of the corresponding standard shadow mask tube of the same size and the same anode power, substantially the same contrast, and greater clipping (purity) tolerance (3.0 compared to 2.4 mils), at the center of the screen 27. The penalty paid for this improvement is the reduction in leaving or white uniformity tolerance to only 1.1 mils. Since the tolerances are expressed in diameters, the actual permissible radial misregister of the beam spot and its dot from the centered position is only 0.55 mil. Successful tests on matrix-dot color tubes made according to this example have shown that this is a practical leaving tolerance at the center of the screen, where the causes of misregister are a minimum. In fact, it is believed that this tolerance can be reduced practically to zero and still produce a satisfactory color picture tube.

However, greater leaving tolerances are necessary at the corners of the tube where the causes of misregister are a maximum. In the matrix-dot tube shown in Table I, the mask apertures are graded to a diameter A of 10.0 mils at the corners, the same as the standard tube shown, and the matrix holes at the corners have a diameter F of 15.0 mils. As a result, in the corners: the light output is about 1.7 times that of the standard tube; the relative contrast is 0.98 or 98%, of the standard tube contrast; the clipping tolerance (5.4 mils) is substantially higher than in the standard tube (4.4 mils) and the leaving tolerance is 3.4 mils, as compared with 4.4 mils for the standard tube, which has been proven to be satisfactory.

The invention is not limited to the particular example given in the last two columns of Table I. The practical limits of the invention, as applied to a matrix-dot tube, are about as follows: glass transmission 50 to 80%; and mask transmission in the range from 16.5 to 22% at the center, which corresponds to a mask aperture diameter range of 12 to 13.8 mils, with the aperture spacing $a$ of 28.1 mils in the above example. In each case, the matrix hole diameter should be 2 to 4 mils greater than the mask aperture diameter, chosen to maintain acceptable contrast and tolerances as explained above. At the corners, the mask transmission should be in the range from 11.8 to 14%, which corresponds to a mask aperture diameter range of 10 to 11 mils, with the aperture spacing of 27.7 mils, and the matrix-hole diameter should be 4 to 5 mils greater than the mask aperture diameter, to obtain acceptable contrast and tolerances. These limits, for tubes having a mask aperture spacing of 28.1 mils at the center and 27.7 at the corners, and also the same $p$ & $q$ values as the standard 25AJP22, are shown by the two examples in Table II:

TABLE II

| | M.D. Tube Example 2 | | M.D. Tube Example 3 | | M.D. Tube Example 4 | |
|---|---|---|---|---|---|---|
| | Center | Corners | Center | Corners | Center | Corners |
| $t_g$ | 60 | 60 | 50 | 50 | 80 | 80 |
| A | 12.0 | 10.0 | 13.4 | 10.5 | 13.8 | 11.0 |
| $T_m$ | .1654 | .1182 | .2062 | .1303 | .2187 | .1390 |
| C | 12.5 | 10.4 | 14.0 | 10.9 | 14.4 | 11.4 |
| E | 13.7 | 11.6 | 15.2 | 12.1 | 15.6 | 12.6 |
| F | 15.5 | 15.0 | 15.8 | 15.6 | 15.8 | 15.4 |
| $T_M$ | .759 | .742 | .788 | .802 | .788 | .782 |
| $T_M/T_m$ | 4.6 | 6.3 | 3.8 | 6.2 | 3.6 | 5.6 |
| RLO | 1.463 | 1.046 | 1.525 | .961 | 2.575 | 1.64 |
| $r_s$ | .2288 | .2246 | .176 | .1787 | .3886 | .3860 |
| SL | 1.463 | 1.046 | 1.525 | .961 | 2.575 | 1.64 |
| CR | 38.3 | 35.2 | 40.9 | 36.8 | 38.8 | 34.1 |
| RC | 1.0 | 1.0 | 1.07 | 1.04 | 1.01 | .97 |
| LT | 1.8 | 3.4 | .6 | 3.5 | 0.2 | 2.8 |
| CT | 4.7 | 5.4 | 2.9 | 4.3 | 2.5 | 4.0 |

In the four examples of matrix-dot color tubes according to the invention given in Tables I and II, the light output or brightness varies from 1.46 to 2.6 times the corresponding light output of a standard tube at the center of the screen, and from 1.3 to 2.3 times at the corners (as compared to 0.715). The contrast varies from 1.0 to 1.07 times the corresponding contrast of the standard tube at the center, and from 0.97 to 1.04 times the standard tube contrast at the corners. Both tolerances are acceptable over the entire screen area.

The effects of increasing one of the following, glass transmission, mask aperture size and matrix hole size, alone, in a positive tolerance matrix type shadow mask color tube are shown in the following chart:

| Increasing | RLO | RC | $r_s$ | LT | CT |
|---|---|---|---|---|---|
| $t_g$ | Increases | Decreases | Increases | No effect | No effect |
| A | Increases | Increases | No effect | Decreases | Decreases |
| F | No effect | Decreases | Increases | Increases | Decreases |

The value 60% for $t_g$ in Example 2 of Table II was chosen to obtain substantial increase in brightness without increasing the mask transmission (aperture size). The upper limit, 80%, for the glass transmission $t_g$ in Table II is about the highest value that can be used and still obtain acceptable contrast and tolerances. It will be noted that the ratio, $T_M/T_m$, of matrix transmission to mask transmission in Table II, is a minimum of 3.6 in the center of the tube, at $t_g = 80\%$, and a minimum of 5.6 at the corners, at $t_g = 80\%$. If these ratios are reduced much below these minima by decreasing the size of the matrix holes, the resulting reduction in the leaving or white uniformity tolerance becomes unacceptable. If these ratios are reduced appreciably by increasing the size of the mask apertures, the resulting reductions in both the white uniformity and clipping tolerances become unacceptable. On the other hand, the maximum $T_M/T_m$ is 4.6 at the center and 6.3 at the corners. Thus, the invention is particularly applicable to combinations of mask apertures and matrix holes wherein the ratio of $T_M$ to $T_m$ lies in the range from 3.5 to 4.7 at the center and in the range from 5.3 to 6.4 at the corners of the mask and screen.

For example, the screen 27 of FIG. 6 may be formed on the inner surface 25 of the faceplate 9, before the panel 5 is sealed to the funnel 7, in the following manner. First the surface 25 is coated with a photosensitive coating, e.g., an aqueous solution of polyvinyl alcohol sensitized with ammonium dichromate. The coating is dried, the mask 35 is assembled to the panel, and the panel is mounted on a conventional "lighthouse" containing a light source and one or more lenses or light-refracting elements for correcting for various causes of misregister. The photosensitive coating is then successively exposed through the mask to a light source positioned at each of three points corresponding to the sources of the three beams in the operation of the tube, to harden dot portions of the coating corresponding to the pattern of holes in the desired matrix. The time and intensity of the light exposure are carefully adjusted to produce the desired matrix opening size. Following exposure, the mask is removed and the unexposed, and hence, unhardened portions of the coating are removed by developing in a suitable solvent, such as water. After drying, the bare areas of the surface 25 between the hardened dots are coated with a matrix 47 of opaque and non-reflective material. This may be done by coating the surface 25 and the dots with a slurry containing about 4.0 weight percent of colloidal graphite in water, drying the coating, treating the coating with a chemically-digestive agent, such as an aqueous solution containing about 35 weight percent of hydrogen peroxide, which causes the hardened polyvinyl alcohol of the dots to swell and soften, and then flushing with water to remove the softened dots and the graphite coating thereon and leave the holes 31 in the matrix 47. Next, the three patterns of red, green and blue phosphor dots 33 are successively printed in the holes 31 in the matrix 47, in three separate exposures on the lighthouse, in the usual manner. The individual dots 33 may just fill the space within each matrix hole 31, or overlap somewhat onto the adjacent matrix material, providing they do not encroach on the next adjacent matrix holes. The effective diameter of the dot 33 is the matrix hole diameter F, since the matrix is opaque to light produced by electrons impinging on the portions of the dots which overlap the matrix. Therefore, such overlap does not affect the clipping tolerance. After the phosphor dots are printed on the matrix 47, the usual electron-transparent reflective aluminum layer is applied to the screen 27.

Figure 9:
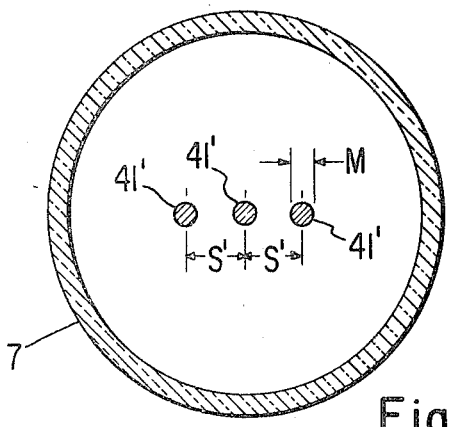
FIG. 9 is a transverse section view, taken on line P—P of FIG. 1, showing an in-line beam arrangement.
Figure 7:
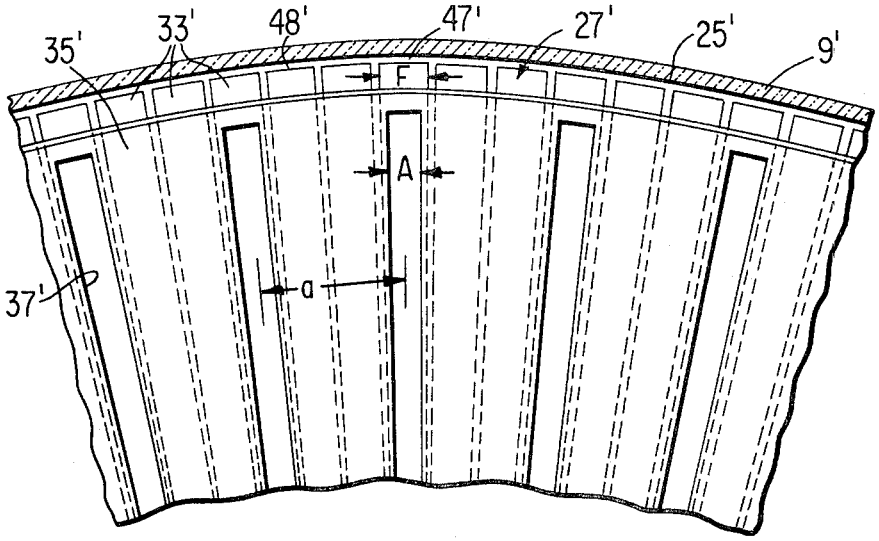
FIG. 7 is a perspective view of a modified mask and faceplate in FIG. 1, looking from above, toward the gun side thereof.
Figure 8:
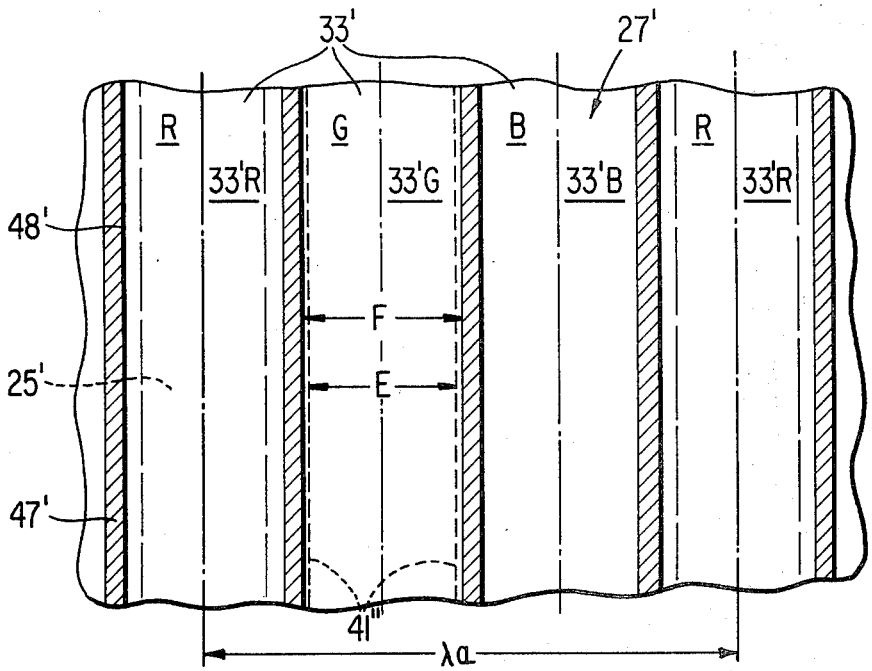
FIG. 8 is an enlarged detail view of the color screen of FIG. 7.

FIGS. 7 and 8 illustrate the invention embodied in a line-screen type shadow mask color tube, in which the spherical faceplate 9 of FIG. 1 is replaced by a cylindrical contour faceplate 9' of generally rectangular shape, and the spherical shadow mask 35 of FIG. 1 is replaced by a cylindrical contour shadow mask 35' of generally rectangular shape. The inner surface 25' of the faceplate 9' is coated with a mosaic screen 27' comprising a matrix 47' of opaque and non-reflective material formed with a multiplicity of spaced parallel elongated holes or slits 48', which correspond to the circular holes 48 in FIG. 6. At least the surface portions of the faceplate 9' within the slits 48' are coated with red, green and blue light emitting phosphor materials to form repeating groups of triads of spaced parallel red, green and blue phosphor lines or strips 33', e.g., 33'R, 33'G and 33'B in FIG. 8. Preferably, the slits 48' and strips 33' extend vertically across substantially the entire width or height of the faceplate, to be scanned substantially at right angles by the horizontal scan of the three beams. The shadow mask 35', which may be a thin sheet of cold-rolled steel, is formed with a multiplicity of elongated apertures of slits 37', each associated with one group of triad of three color phosphor strips 33', as shown in FIG. 7. The remainder of the structure of the tube in this embodiment may be substantially the same as in the matrix-dot shadow mask tube of FIG. 1, except that the delta electron gun structure 39 preferably should be replaced by an "in-line" type gun structure in which the three beams are projected from three electron guns spaced apart in a horizontal plane, e.g., as shown in Francken U.S. Pat. No. 2,849,647, dated Aug. 26, 1958. FIG. 9 shows the in-line arrangement of three beams 41' from such a gun structure. The spacing between each of the two outer beams and the central beam in the plane of deflection P—P may be the same as the horizontal spacing of each beam from the central axis in the delta gun example, that is $S' = S \cos 30° = 0.190$ inch. The elongated area 41'' of the screen impinged by one of the beams 41' as it is scanned across a slit 37' is shown in dotted lines in FIG. 8.

As an example, for a 25 inch 90° matrix-line tube having a cylindrical faceplate with a radius of curvature of 33.875 inches, which is the same curvature as the spherical faceplate in the standard tube and the matrix-dot tube examples described above, a horizontal spacing $a$ between vertically extending mask slits 37' of 24 mils, and using the same value of $L_o$ (13.697 inches) as in the matrix-dot example, the value of $q$ at the center becomes $$q_o = \frac{L_o a}{3S'} = .577'';$$

$P_o = L_o - q_o = 13.1203$ inches; and $\lambda_o = 1.04395$. If the magnification $\lambda'$ at the corners of the screen and mask is reduced 0.6% (for example) from the center $\lambda_o$, to compensate for the dynamic convergence degrouping of the beam spots in tube operation, $\lambda' = 1.0377$. At 45° deflection to a point at a diagonal distance of 11.77 inches from the central axis, the distance L' from the color center in the plane P—P to the corner of the cylindrical faceplate is 16.645 inches. Thus, q' at the corners is $$q' = L'\left(1 - \frac{1}{\lambda'}\right) = .805'',$$

and $p' = L' - q' = 16.040$ inches. The slit spacing $a$ at the corners is the same as at the center.

The values of beam spot widths and tolearances are calculated as in the matrix-dot embodiment by using mask slit width A for mask aperture diameter A, matrix slit width F for matrix aperture diameter F, and slit spacing $a$ for aperture spacing $a$. That is, $C = A\lambda$, $$E = C + M\frac{P}{q},$$

$LT = F - E$, and $$CT = \frac{2a\lambda}{3} - F - E.$$

The mask transmission $T_m$ is A/a, and the matrix transmission $T_M$ is $3F/\lambda a$, because of the cylindrical contours. The relative light output, reflectivity and relative contrast are calculated as for the dot-type tube. Analogous to the matrix-dot tube of FIGS. 1–6, the width F of the matrix holes 48' is made substantially larger than the width of the mask slits 37', to facilitate depositing the phosphor screen by direct photographic methods.

TABLE III

| | Matrix-Line Tube Example 1 | | Matrix-Line Tube Example 2 | |
|---|---|---|---|---|
| | Center | Corners | Center | Corners |
| Glass transmission $t_u$ | 69 | 69 | 69 | 69 |
| Mask slit spacing $a$ | 24 | 24 | 30 | 30 |
| Mask-screen spacing $q$ | .577 | .605 | .721 | .781 |
| Tube magnification $\lambda$ | 1.04395 | 1.0377 | 1.05556 | 1.04923 |
| Mask slit width A | 5.0 | 3.6 | 6.5 | 4.5 |
| Mask transmission $T_m$ | .2084 | .150 | .2167 | .150 |
| Beam spot width C | 5.2 | 3.7 | 6.8 | 4.7 |
| Beam spot width E | 6.4 | 4.9 | 8.0 | 5.9 |
| Matrix slit width F | 7.4 | 7.0 | 9.1 | 9.0 |
| Matrix transmission $T_M$ | .886 | .843 | .862 | .858 |
| Ratio $T_M/T_m$ | 4.3 | 5.6 | 4.0 | 5.7 |
| Relative Light Output RLO | .212 | 1.526 | 2.2 | 1.52 |
| Screen reflectivity $r_s$ | .3316 | .3174 | .3237 | .3224 |
| Stray light SL | 2.1 | 1.526 | 2.2 | 1.5 |
| Contrast ratio CR | 38.3 | 35.6 | 38.7 | 35.3 |

TABLE III-continued

| | Matrix-Line Tube Example 1 | | Matrix-Line Tube Example 2 | |
|---|---|---|---|---|
| | Center | Corners | Center | Corners |
| Relative contrast RC | 1.0 | 1.01 | 1.01 | 1.01 |
| Leaving tolerance LT | 1.0 | 2.1 | 1.1 | 3.1 |
| Clipping tolerance CT | 2.9 | 4.8 | 4.0 | 6.1 |

Table III shows two examples of matrix-line shadow mask tubes embodying the invention. Both examples use 69% glass for the faceplate 9', as in the last two columns of Table I. Example 1 uses an aperture spacing *a* of 24 mils, while Example 2 uses an aperture spacing *a* of 30 mils, the values of *q*, L and *p* being different for the two spacings. As shown, both examples have more than twice the light output as the standard shadow mask tube (cols. 1 and 2 of Table I), equal contrast, and acceptable positive tolerances, at the center and edges of the tube.

TABLE IV

| | M.L. Tube Example 3 | | M.L. Tube Example 4 | | M.L. Tube Example 5 | |
|---|---|---|---|---|---|---|
| | Center | Corners | Center | Corners | Center | Corners |
| $t_g$ | 60 | 60 | 50 | 50 | 80 | 80 |
| $a$ | 30 | 30 | 30 | 30 | 30 | 30 |
| A | 5.0 | 3.6 | 7.0 | 4.8 | 7.0 | 4.8 |
| $T_m$ | .1667 | .120 | .2333 | .160 | .2333 | .160 |
| C | 5.3 | 3.8 | 7.4 | 5.0 | 7.4 | 5.0 |
| E | 6.5 | 5.0 | 8.6 | 6.2 | 8.6 | 6.2 |
| F | 8.0 | 8.0 | 9.1 | 9.1 | 9.1 | 9.1 |
| $T_M$ | .759 | .762 | .862 | .867 | .862 | .867 |
| $T_M/T_m$ | 4.55 | 6.3 | 3.7 | 5.4 | 3.7 | 5.4 |
| RLO | 1.48 | 1.06 | 1.72 | 1.18 | 2.751 | 1.89 |
| $r_s$ | .2288 | .2295 | .1890 | .190 | .4213 | .4236 |
| SL | 1.48 | 1.06 | 1.72 | 1.18 | 2.75 | 1.89 |
| CR | 38.5 | 35.2 | 41.2 | 38.2 | 38.4 | 34.7 |
| RC | 1.0 | 1.01 | 1.08 | 1.09 | 1.0 | 1.0 |
| LT | 1.5 | 3.0 | .5 | 2.9 | .5 | 2.9 |
| CT | 6.6 | 8.0 | 3.4 | 5.7 | 3.4 | 5.7 |

As shown in Table IV, the practical limits of the invention as applied to a matrix-line shadow mask tube are about as follows: glass transmission 50 to 80% (as in the matrix-dot tube); and mask transmission 16 to 24% at the center. The matrix slit width at the center should be 1.5 to 3 mils greater than the mask slit width, chosen to maintain acceptable contrast and tolerances. At the corners, the mask transmission should be in the range from 12 to 16%, and the matrix slit width should be 4 to 5 mils greater than the mask slit width.

In the five examples of matrix-line tubes given in Tables III and IV, the relative light output varies from 1.48 to 2.75 times the corresponding light output of the standard shadow mask tube at the center of the screen, and from 1.06 to 1.89 times at the corners (as compared to 0.715). The relative contrast varies from 1.0 to 1.08 times the corresponding contrast in the standard tube at the center, and from 1.0 to 1.09 times the standard tube contrast at the corners. The purity (clipping) tolerance is nearly as great, or greater than, that of the standard tube, and the white uniformity (leaving) tolerance is acceptable, over the entire screen area.

In each of the examples given above, the contrast ratio has been calculated for an ambient light of 2 foot lamberts which exists in the average home room under mininum light conditions. If the value of 10 foot lamberts is used instead, the contrast ratio for the standard tube is 20.13 at the center and 16.4 at the corners; and for the matrix-dot example in Table I is 20.37 at the center and 15.55 at the corners. Thus, the relative contrast of the matrix-dot tube is 1.01 at the center and 0.95 at the corners.

I claim:

1. In a color picture tube of the shadow mask type comprising an evacuated envelope including a transparent faceplate, a mosaic screen located on an inner surface of said faceplate, a multiapertured shadow mask mounted adjacent to but spaced from said screen, and means for generating and projecting electrons along a plurality of convergent paths through said mask and to said screen; said screen comprising a color phosphor layer comprising a multiplicity of spaced-apart color phosphor elements disposed in groups of different color light emitting elements, each group having the same number of elements as the number of said convergent paths, the elements of each group being respectively aligned with said convergent paths through one of the apertures of said mask; said screen further comprising a matrix layer of light absorbing material filling the entire space between said phosphor elements and having holes through which said elements are exposed through said faceplate;

the improvement comprising, said shadow mask including a multiplicity of spaced parallel elongated apertures in the form of slits;

said matrix layer including a multiplicity of spaced parallel elongated opaque elements forming elongated holes therebetween in which elongated color phosphor elements are located, the size of each of said matrix holes being larger than the size of the respective electron spot produced on said screen during operation of said tube and the light transmission of said faceplate being greater than 41%.

2. A color picture tube as in claim 1, having generally rectangular faceplate, screen and mask, and having substantially the dimensions and characteristics set forth in Example 1 of Table III.

3. A color picture tube as in claim 1, having generally rectangular faceplate, screen and mask, and having substantially the dimensions and characteristics set forth in Example 2 of Table III.

4. A color picture tube as in claim 1, having generally rectangular faceplate, screen and mask, and having substantially the dimensions and characteristics set forth in Example 5 of Table IV.

* * * * *